US005097957A

United States Patent [19]

Adams, Jr. et al.

[11] Patent Number: 5,097,957

[45] Date of Patent: Mar. 24, 1992

[54] PORTABLE HINGED TRAY APPARATUS

[76] Inventors: William F. Adams, Jr., R.D. #1 Box 113, Warriors Mark, Pa. 16877; Joseph A. Hughes, 720 S. Plymouth Pl., Anaheim, Calif. 92806

[21] Appl. No.: 594,417

[22] Filed: Oct. 5, 1990

[51] Int. Cl.[5] ..... B65D 6/04; A47B 3/06

[52] U.S. Cl. ..... 206/557; 108/14; 108/17; 108/153; 220/7; 220/495

[58] Field of Search ..... 220/495, 1.5, 6, 7; 206/557; 108/14, 17, 55.3, 56.3, 124, 149, 153, 157

[56] References Cited

U.S. PATENT DOCUMENTS

| | | | |
|---|---|---|---|
| 1,487,582 | 3/1924 | Latta et al. | 220/6 |
| 1,696,193 | 12/1928 | Deland | 108/157 X |
| 1,761,325 | 6/1930 | Burson | 220/6 |
| 1,904,897 | 4/1933 | Kahrs | 108/157 X |
| 2,937,062 | 5/1960 | Kruse | 108/157 X |
| 4,090,633 | 5/1978 | Trubiano | 220/6 |
| 4,230,051 | 10/1980 | Mays | 108/55.3 X |
| 4,318,478 | 3/1982 | De Winter | 220/495 X |

*Primary Examiner*—Bryon P. Gehman
*Attorney, Agent, or Firm*—Leon Gilden

[57] ABSTRACT

The apparatus sets forth a tray organization that is usable wherein first and second rigid base members are hingedly mounted relative to one another with plural pairs of apertures mounted on each top surface of each base plate to receive plural pairs of support rods wherein the support rods are joined at their upper ends by a spanning U-shaped cap member. The rods and cap members are separable and are receivable within recesses formed within each base plate to secure the rods and cap members within the base plates during periods of non-use during transport and storage of the organization.

7 Claims, 4 Drawing Sheets

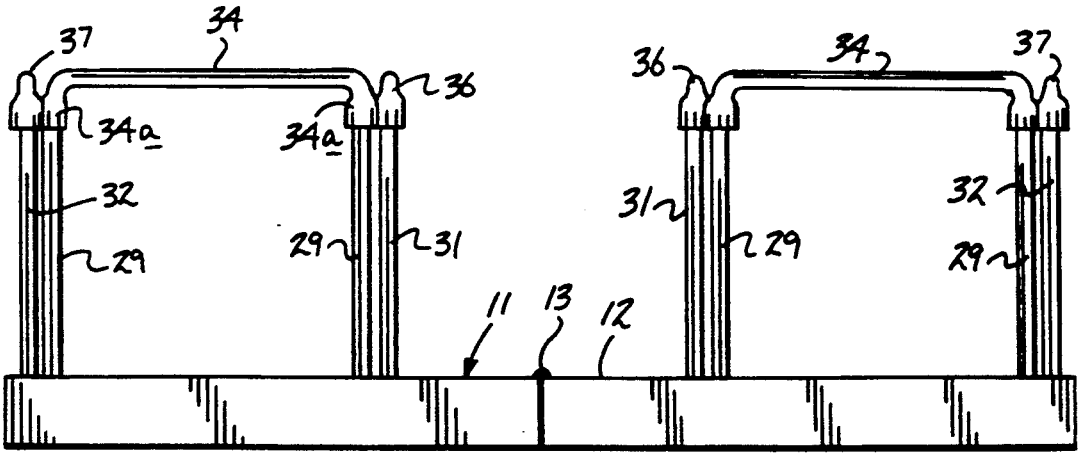
FIG 5
FIG 6
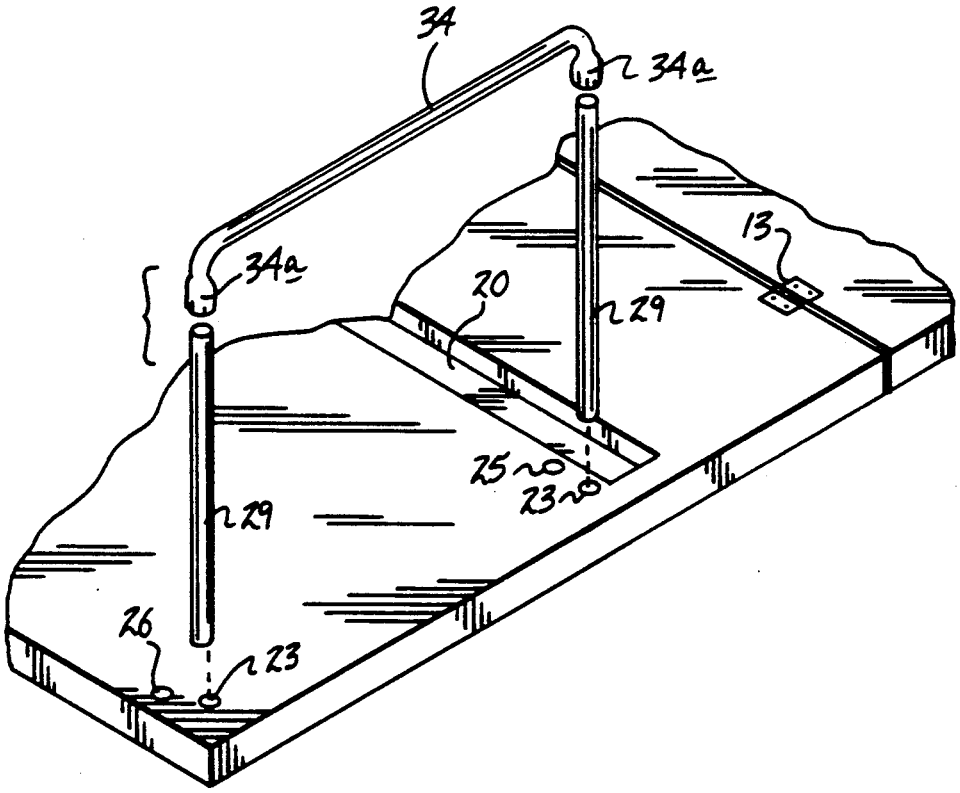

PORTABLE HINGED TRAY APPARATUS

BACKGROUND OF THE INVENTION

1. Field of the Invention

The field of the invention relates to tray constructions, and more particularly pertains to a new and improved portable tray apparatus wherein the same provides a structure for the reception of plural pairs of cups and food within an upper surface of the apparatus and may be subsequently folded for storage and transport thereof.

2. Description of the Prior Art

Tray apparatus of various types have been utilized throughout the prior art for the support of various items thereon. The present invention addresses the problem of finding a portable readily folded tray structure that provides distinct securement perimeters for receiving drinking vessels therewithin and a support surface intermediate the perimeters for mounting food components thereon. Examples of the prior art tray structure may be found in U.S. Pat. No. 4,732,274 to Bouton wherein a compartmentalized tray is provided with a single cup mounting cabby medially of the tray.

U.S. Pat. No. 4,155,198 to Kelley sets forth a compartmentalized tray for storage of various horticultural components therewithin.

U.S. Pat. No. 4,872,560 to Langenbeck sets forth a tray utilizing a matrix of cavities for storing drinking vessels therewithin with a surrounding perimeter wall.

U.S. Pat. No. 4,469,271 to Kulig sets forth a multipocketed tray readily erected for use.

As such, it may be appreciated that there continues to be a need for a new and improved portable tray apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of tray apparatus present in the prior art, the present invention provides a new and improved portable tray apparatus wherein the same provides for a tray structure that is easily erected and readily folded medially of the tray structure for transport and storage thereof. As such, the general purpose of the present invention, which will be described subsequently in greater detail, is to provide a new and improved portable tray apparatus which has all the advantages of the prior art tray apparatus and none of the disadvantages.

To attain this, the portable tray apparatus of the instant invention includes the apparatus sets forth a tray organization that is usable wherein first and second rigid base members are hingedly mounted relative to one another with plural pairs of apertures mounted on each top surface of each base plate to receive plural pairs of support rods wherein the support rods are joined at their upper ends by a spanning U-shaped cap member. The rods and cap members are separable and are receivable within recesses formed within each base plate to secure the rods and cap members within the base plates during periods of non-use during transport and storage of the organization.

There has thus been outlined, rather broadly, the more important features of the invention in order that the detailed description thereof that follows may be better understood, and in order that the present contribution to the art may be better appreciated.

There are, of course, additional features of the invention that will be described hereinafter and which will form the subject matter of the claims appended thereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable tray apparatus which has all the advantages of the prior art portable tray apparatus and none of the disadvantages.

It is another object of the present invention to provide a new and improved portable tray apparatus which may be easily and efficiently manufactured and marketed.

It is a further object of the present invention to provide a new and improved portable tray apparatus which is of a durable and reliable construction.

An even further object of the present invention is to provide a new and improved portable tray apparatus which is susceptible of a low cost of manufacture with regard to both materials and labor, and which accordingly is then susceptible of low prices of sale to the consuming public, thereby making such portable tray apparatus economically available to the buying public.

Still yet another object of the present invention is to provide a new and improved portable tray apparatus which provides in the apparatuses and methods of the prior art some of the advantages thereof, while simultaneously overcoming some of the disadvantages normally associated therewith.

Still another object of the present invention is to provide a new and improved portable tray apparatus which may be compactly stored when not being utilized.

Yet another object of the present invention is to provide a new and improved portable tray apparatus wherein the same may be readily erected or conversely inter-folded for storage and transport thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an orthographic side view taken in elevation of the instant invention.

FIG. 6 is an isometric illustration of mounting of the support rod structure into the tray organization of the instant invention.

DESCRIPTION OF THE PREFERRED EMBODIMENT

Figures 1, 2, 3:
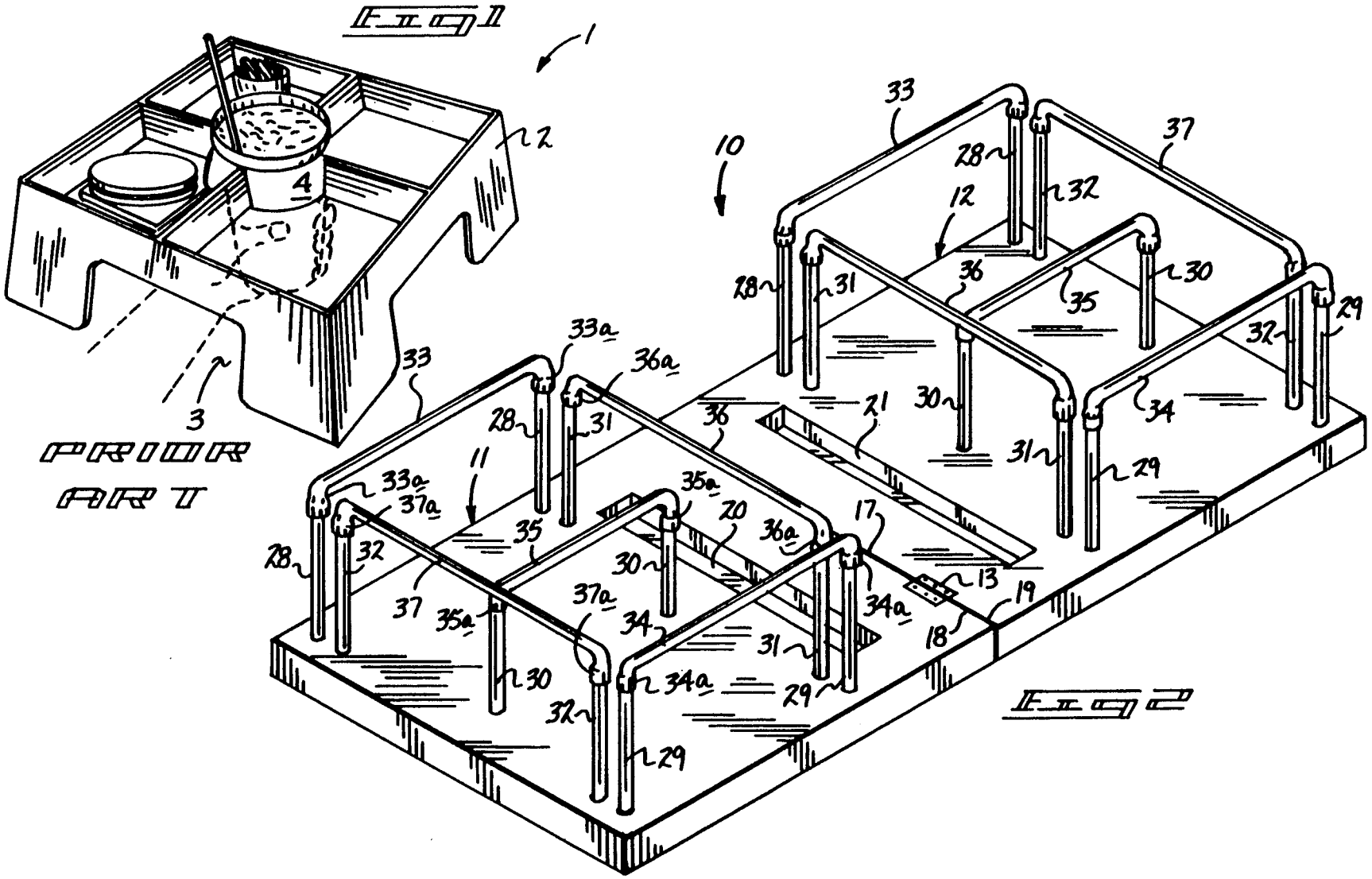
FIG. 3 PRIOR ART
FIG. 1 is an isometric illustration of a prior art tray apparatus.
FIG. 2 is an isometric illustration of the instant invention.
FIG. 3 is an orthographic top view of the instant invention.
Figure 3:
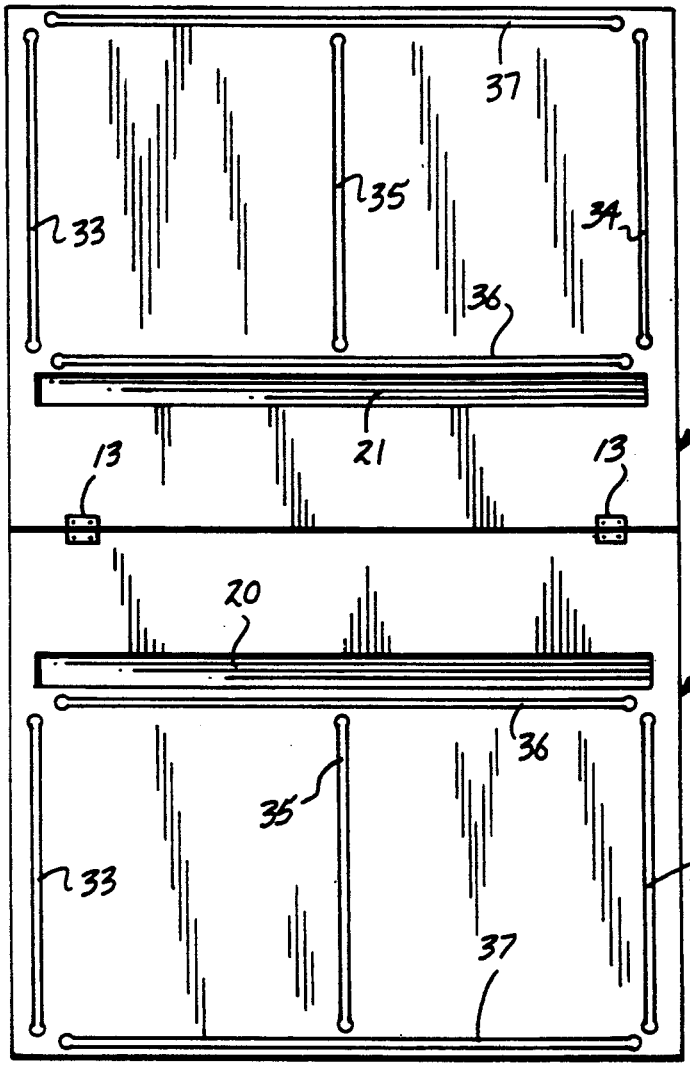

With reference now to the drawings, and in particular to FIGS. 1 to 8 thereof, a new and improved portable tray apparatus embodying the principles and concepts of the present invention and generally designated by the reference numeral 10 will be described.

FIG. 1 illustrates a prior art tray apparatus 1 wherein a compartmentalized tray structure includes a cavity 3 directed between the side wall of the tray structure to permit an individual to grasp a cup receiving member 4 that projects through a bottom surface of the tray structure.

More specifically, the portable tray apparatus 10 of the instant invention essentially comprises a first rigid base plate 11 hingedly mounted to a second rigid base plate 12. A plurality of hinge members 13 hingedly mount the first and second base plates together at the forward edges 18 and 19 respectively o the first and second base plates 11 and 12. The base plates 11 and 12 are of a generally rectangular configuration and are of a mirror image construction relative to one another and each include a respective first and second elongate storage recess 20 and 21 arranged parallel to and adjacent the respective first and second base plate forward edges 18 and 19. The abutment of the first and second base plate forward edges 18 and 19 define a first and second base plate interface 17 in a coextensive relationship of the first and second forward edges 18 and 19 relative to one another.

Figure 4:
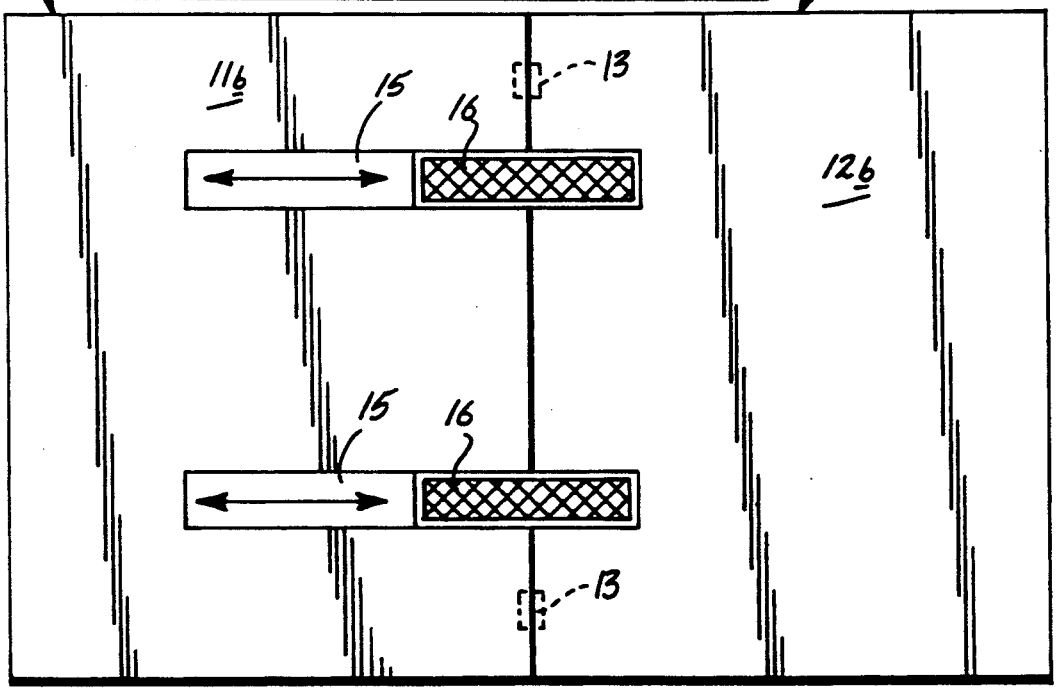
FIG. 4 is an orthographic bottom view of the instant invention.

Reference to FIG. 4 illustrates use of parallel recess grooves 15 that extend in longitudinal alignment from the bottom surface of the first and second base plates with a locking bar 16 slidably arranged within each groove 15 that is positionable within the groove 15 within the bottom surface of the first base plate and slidable to overlie the interface 17 to thereby fixedly latch the first and second base plates 11 and 12 together when in an extended configuration as illustrated in FIGS. 2 and 3 for example.

Each top surface of each portable tray includes plural pairs of receiving apertures 22 positioned adjacent the left sides 18*c* and 19*c* respectively of the first and second base plates.

a second pair of receiving apertures 23 are positioned adjacent the right sides 18*b* and 19*b* of the receiving apertures with a third pair of receiving apertures 24 positioned medially of the first and second pair of receiving apertures. A fourth pair of receiving apertures 25 are positioned adjacent the elongate storage recess 20 and 21 respectively of each of the first and second base plates with a fifth pair of receiving apertures 26 positioned adjacent the rear terminal edge 18*a* and 19*a* respectively of the first and second base plates. The respective first through fifth pairs of receiving apertures receive a respective first through fifth pair of support rods 28 through 32 in a manner as illustrated in FIGS. 2 and 6 for example. Each lower terminal end of each support rod is complementarily received within a respective aperture. Each upper terminal end of each rod pair is arranged to receive a socket end of an associated U-shaped cap rod. For example a first through fifth cap rod 33 through 37 inclusively is mounted on a respective first through fifth pairs of support rods 28 through 32 respectively. The first cap rod includes first cap rod socket ends 33*a*, the second cap rod includes second cap rod socket ends 34*a*, the third cap rod 35 includes third cap rod socket ends 35*a*, the fourth U-shaped cap rod 36 includes fourth cap rod socket ends 36*a* and the fifth U-shaped cap rod 37 includes fifth cap rod socket ends 37*a* with each socket end complementarily receiving an upper terminal end of an associated support rod.

When assembled, a plural pair of cup receiving cavities are defined for mounting of a drinking cup and the like therewithin. A support surface between the fourth rod pair and cap rods is provided for the mounting and transport of various food components thereon such as during a sporting event and the like to support the food components from a concession stand to a seating area for example.

An alternative manner of constructing the support rods and cap rods may include the forming of a respective cap rod and support rod pair as a unitary construction with the rod members of each rod pair inter-folded relative to respective cap rod.

Figures 7, 8:
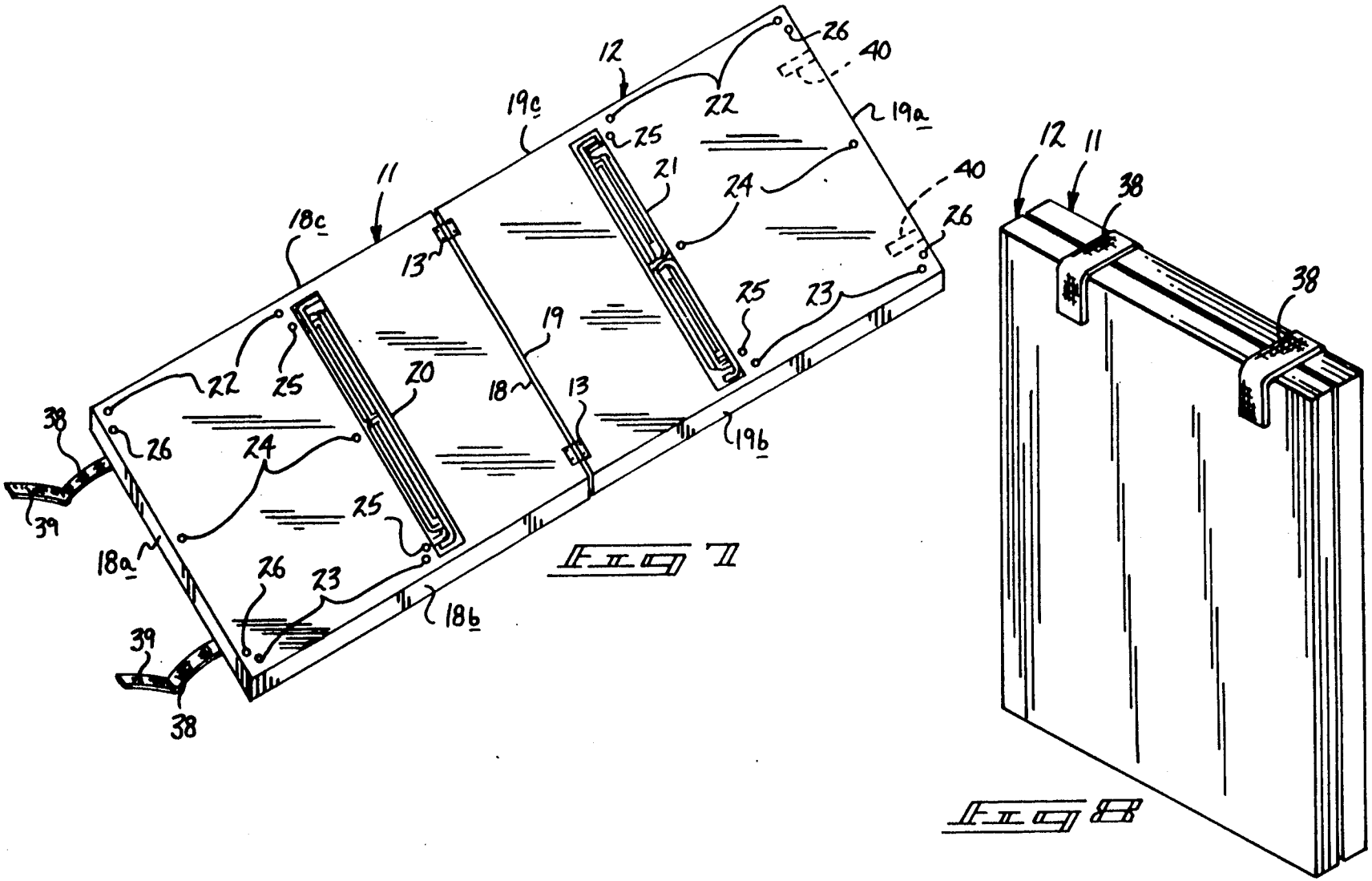
FIG. 7 is an isometric illustration of the instant invention with the various support rods contained within associated cavities of the tray structure.
FIG. 8 is an isometric illustration of the instant invention in a folded configuration for transport and storage.

During storage of the organization in a manner as illustrated in FIG. 7, the support rods and respective cap rods are disassembled and positioned within the respective receiving recesses defined by the first and second elongate storage recesses 20 and 21. Thereafter, the organization may be inter-folded in a manner as illustrated in FIG. 8. It may be desired to utilize securement straps such as flexible securement straps 38 that are mounted adjacent the first base plate rear terminal edge 18*a* with a first hook and loop fastener surface 39 for securement to mounting straps 40 that are mounted to the bottom surface of the second base plate 12 adjacent the second base plate upper terminal edge 19*a* as illustrated in FIG. 7.

The mounting straps 40 will include a second hook and loop fastener surface to permit securement of the flexible securement strap 38 to the mounting straps 40 in a manner as illustrated in FIG. 8 for transport of the organization as a compact unitary structure as illustrated.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable tray apparatus comprising in combination, a first base plate including a first base plate forward edge coextensively and hingedly mounted to include at least one hinge member to a second base plate forward edge of a second base plate where the first and second base plates are formed as a mirror image relative to one another, the first base plate including a first matrix of apertures and the second base plate including a second matrix of apertures wherein the first and second matrices of apertures re of a mirror image relative to one another, the first matrix of apertures including a plurality of first separably removable support rods mounted within the first matrix of apertures to define first compartments within an upper surface of the first base plate, the second matrix of apertures including a second plurality of support rods separably removable from the second matrix of apertures to define second compartments, slide lock means displaceable for locking the first and second base plates in a first position aligned relative to one another, and the slide lock means repositionable to permit folding of the first and second base plates about the at least one hinge member to a second position with the top surfaces of the first and second base plates in a confronting relationship in the second position.

2. Apparatus as set forth in claim 1 with the slide lock means including a first elongate groove and a second elongate groove with the first and second elongate grooves each extending into a bottom surface of the first base plate and the second base plate, and each groove including a slidable locking bar extensible from the first base plate to overlie the first base plate and second base plate to effect locking of the first base plate and second base plate in the first position.

3. Apparatus as set forth in claim 2 wherein the first base plate includes a first base plate rear terminal edge spaced from and parallel the first base plate forward edge and the second base plate includes a second base plate rear edge spaced from and parallel the second base plate forward edge, and the first base plate including a right edge and a left edge arranged parallel relative to one another and orthogonally between its rear edge, and the second base plate including a second base plate right edge and a second base plate left edge arranged parallel relative to one another and orthogonally between the second base plate forward edge and the second base plate rear edge, and the first matrix of apertures including a first pair of receiving apertures positioned adjacent the first base plate left edge, and a second pair of receiving apertures positioned adjacent the first base plate right edge, and a third pair of receiving apertures positioned medially between the first pair of receiving apertures and the second pair of receiving apertures, and a fourth pair of receiving apertures positioned in a spaced relationship relative to the first base plate forward edge, and a fifth pair of receiving apertures positioned adjacent the first base plate rear edge, and the second base plate matrix of apertures including a second base plate first pair of apertures positioned adjacent the second base plate left edge, and a second base plate second pair of receiving apertures positioned adjacent a second base plate right edge, and a second base plate third pair of receiving apertures positioned medially between the second base plate first pair of receiving apertures and the second base plate second pair of receiving apertures, and a second base plate fourth pair of receiving apertures positioned adjacent to and spaced from the second base plate forward edge, and a second base plate fifth pair of receiving apertures positioned adjacent the second base plate rear edge.

4. Apparatus as set forth in claim 3 wherein each pair of receiving apertures receives a respective pair of support rods, and each pair of support rods includes a U-shaped cap slidably mounted thereon to define the respective compartments within the first and second base plates.

5. Apparatus as set forth in claim 4 wherein each U-shaped cap rod includes a pair of socket ends to complementarily receive an upper terminal end of each respective pair of support rods.

6. Apparatus as set forth in claim 5 including a first elongate storage recess positioned parallel to and within the first base plate below the top surface of the first base plate, and a second elongate storage recess positioned within the second base plate below the second base plate top surface wherein the first and second storage recesses are arranged to receive the support rods and cap rods when disassembled from their respective first and second matrix of apertures.

7. Apparatus as set forth in claim 6 wherein the first base plate includes a first strap pair, the first strap pair includes first hook-and-loop fastener surfaces and the second base plate includes mounting straps mounted to the bottom surface of the second base plate adjacent the second base plate rear terminal edge to securably receive the securement straps in an interlocked relationship when the first and second base plates are pivoted to the second position.

* * * * *